United States Patent [19]

Rietveld

[11] 4,054,237

[45] Oct. 18, 1977

[54] NAIL SETTING TOOL

[76] Inventor: Frank P. Rietveld, 1314 Vickie Lane, Matthews, N.C. 28105

[21] Appl. No.: 687,676

[22] Filed: May 19, 1976

[51] Int. Cl.[2] ..... B25C 7/00

[52] U.S. Cl. ..... 227/147; 145/46

[58] Field of Search ..... 227/109, 147, 156; 145/46

[56] References Cited

U.S. PATENT DOCUMENTS

| | | | |
|---|---|---|---|
| 541,038 | 6/1895 | Clark | 227/147 |
| 1,575,582 | 3/1926 | Joy | 227/156 |
| 2,871,480 | 2/1959 | Pezza et al. | 145/46 |
| 2,979,092 | 4/1961 | Bradford | 145/46 |

*Primary Examiner*—Granville Y. Custer, Jr.
*Attorney, Agent, or Firm*—Harry R. Dumont

[57] ABSTRACT

Driver apparatus for precisely locating and driving nails or other similar pointed fasteners. Included is a base for locating the driver on the workpiece itself including a V slot entrance for locating the driver in driving relationship to a nail which may be already prelocated on the workpiece. The apparatus includes as its basic parts a nail driver, a holder including the base portion and a spacer which is interchangeably fixed to the lower contact end of the nail driver for presetting with precision the depth to which the nail is to be driven.

6 Claims, 6 Drawing Figures

FIG. 1
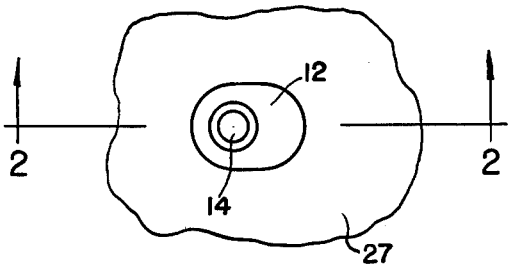
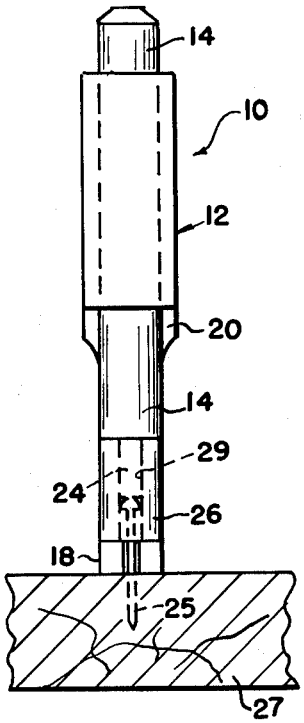
FIG. 4
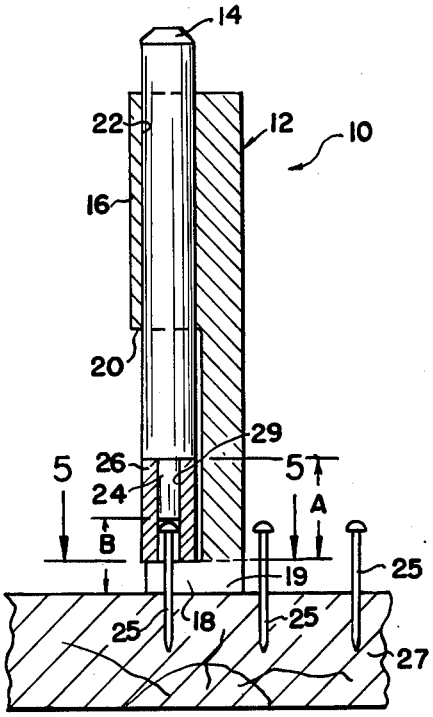
FIG. 2
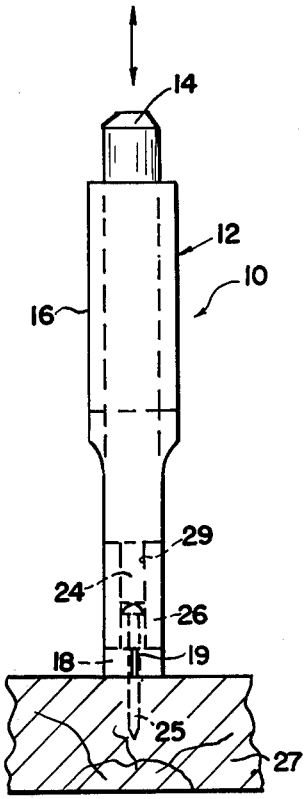
FIG. 3
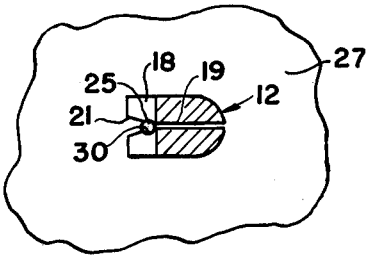
FIG. 5
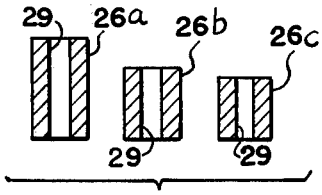
FIG. 6

NAIL SETTING TOOL

BACKGROUND OF THE INVENTION

I. Field of the Invention

This invention relates generally to an automatically positioning nail driver which includes means for centering the driver over the center of the nail and a further means selectively interchangable and operable in combination with a striking nail driver to adjust the stroke of the nail driver and thus the depth to which the nail is driven into a wood or like material workpiece.

There is a need for precise setting of nails before their being driven into a workpiece surface. Such a device is important in making small sized furniture, toys, or other like wooden articles. It is also important that the depth to which the nail is driven in each case be uniform. This is particularly desirable when the nail driving is done for "string art" and "wire art" applications which are currently in vogue. The aesthetic effect of string art pieces is largely dependent on this uniform depth condition.

Problems have been encountered in prior art nail set devices in that they are not readily adjustable to control the depth to which the nail is driven to conform with the particular job being done.

Prior art devices known generally include relatively complicated mechanisms and are not readily movable and held in position on the workpiece to enable the accurate positioning and striking required.

II. Summary of the Invention

The present invention provides an exceedingly simplified and efficient nail driver apparatus with which the operator is enabled by a simple interchange of a sleeve element to alter the depth of the distance to which the nail is to be driven so that absolute uniformity is assured for all nails.

BRIEF DESCRIPTION OF THE DRAWINGS

The several objects and advantages of the present invention will become apparent to those skilled in the art when the following description of the best mode contemplated for practicing the invention is read in conjunction with the accompanying drawings, wherein like reference numerals refer to the same or similar elements, and in which:

FIG. 1 is a top plan view showing the driver in place on a workpiece surface;

FIG. 2 is a vertical sectional view of the driver shown engaging the nail head at its extreme downward travel limit in driving the nail into the workpiece;

FIGS. 3 and 4 are respective right and left side elevational views of the apparatus of FIG. 2;

FIG. 5 is a view taken along a section line 5—5 of the driver of FIG. 2; and FIG. 6 is a cross sectional view showing several different size replaceable sleeves usable with the driver device.

DETAILED DESCRIPTION OF THE PREFERRED EMBODIMENT

As shown in FIGS. 1 and 2, the driver according to the present invention is slidably movable into position by hand. The driver is indicated generally by the numeral 10. The basic operating parts of the driver include a holder 12 and a nail driver 14. The holder 12 will be seen to include an upper body portion 16 and a lower base 18. A lower laterally cut out portion 20 is formed intermediate the upper portion 16 of the body 12 and the base 18. The body 12 further includes a central bore 22 adapted to slidably receive the nail driver 14. The nail driver 14 has extending from its lower end a reduced diameter cylindrical striking end 24. The striking end 24 has fitted over it a sleeve 26. The sleeve 26 in turn has a central bore 29 engagable and sized as to fit with a light pressure fit over the striking end 24.

In keeping with the teachings of this invention, a plurality of different length sleeves 26a, 26b and 26c, are provided along with the driver 10. As shown in the FIG. 2 drawing, the length of each of the different sleeves 26 a-c, once fitted over the striking end 24 of the nail driver 14 determines the length of the downward stroke provided to the nail driver 14. Otherwise stated, the over all length A of the selected sleeve 26*a–c* controls the depth to which the individual nail 25 is driven. With reference to the FIG. 2 drawing, the final length of the nail 25 protruding from the workpiece 27 surface is illustrated. It will be seen that the lower cut out portion 20 of the body 12 permits raising of the nail driver 14 to a point where one of several available adjusting sleeves 26*a–c* may be selectively fitted to the end of the nail driver 14 at its reduced diameter striking end 24. With each subsequent stroke, a nail 25 is driven to a uniform depth in the workpiece 27.

FIG. 5 shows the detail of the lower base portion 18 of the body 12. The base 18 is bifurcated along the line 19 and includes a notched opening 21 which facilitates the alignment of the driver 10 with a prelocated nail 25. Alternately the driver 10 can be prelocated and the nail 25 then slid into the notch 21 preliminary to its being driven into the workpiece 27. An inwardly formed circular opening 30 is included at the inner end of the notch 21 as shown.

A hammer or mallet is ordinarily required to strike the upper end of the nail driver 14 a blow of sufficient force to drive the nail home.

It will thus be seen that it is only required that the base 18 be slid over the work from nail 25 to nail 25 as the work is done. A blow is struck to the nail driver 14 as each nail is centered in the opening 21 of the base 18. The operation proceeds smoothly from nail to nail. The nailing work in carpentry is speeded up. Most importantly, each nail is driven to the same accurately predetermined depth. The present invention allows for rapid and accurate presetting of this depth in a manner and by a means not possible with prior art devices.

I claim:

1. A precision nail driver for driving a nail into the surface of a workpiece to a predetermined uniform depth comprising:

- a base having a lower surface slidably movable over the workpiece surface;
- a holder mounted on said base;
- a lower lateral cut out formed in said holder for providing an opening vertically extending from the base;
- said holder further having a central bore extending there through into registration with said cut out portion;
- a nail driver slidably movable downwardly and upwardly in said bore;
- a spacer means of predetermined length removably mounted on the lower end of said nail driver and engagable with the upper surface of said base to provide a lower limit to the stroke of said nail driver whereby each nail is partially driven into the workpiece.

2. The combination as set forth in claim 1 wherein said nail driver includes at its lower end a reduced diameter end portion and wherein said spacer comprises a sleeve having a bore for engaging said reduced diameter end portion in holding relationship to provide said lower limit of the stroke.

3. The combination as set forth in claim 1 wherein said base includes a bifurcated portion and a notched opening for receiving and locating a preset nail in predetermined centered relationship to the lower end of said nail driver.

4. The combination as set forth in claim 1 wherein said spacer means comprising a sleeve axially extending in a downward direction from said nail driver.

5. The combination as set forth in claim 1 wherein said cut out portion of said holder is of a vertical sizing substantially greater than the sizing of said spacer to accommodate selective removal and substitution of different length spacer means for varying the nail driving stroke of the nail driver.

6. The combination as set forth in claim 3 wherein said bifurcated base includes a notched opening and an inwardly formed circular opening for seating each said preset nail in a centered position with respect to the lower end of said nail driver.

* * * * *